US009708752B2

(12) United States Patent
Latout et al.

(10) Patent No.: US 9,708,752 B2
(45) Date of Patent: Jul. 18, 2017

(54) IRON COMPRISING A BODY AND A METAL SOLEPLATE FOLDED BACK AGAINST THE BODY

(71) Applicant: SEB S.A., Ecully (FR)

(72) Inventors: Gerald Latout, Eyzin-Pinet (FR); Jose Bolota, Mions (FR); Christian Giovalle, Moidieu-Detourbe (FR); Pascal Benesteau, Oullins (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 14/960,883

(22) Filed: Dec. 7, 2015

(65) Prior Publication Data

US 2016/0160433 A1 Jun. 9, 2016

(30) Foreign Application Priority Data

Dec. 8, 2014 (FR) ..... 14 62081

(51) Int. Cl.
*D06F 75/38* (2006.01)
*D06F 75/08* (2006.01)

(52) U.S. Cl.
CPC ..... *D06F 75/38* (2013.01); *D06F 75/08* (2013.01)

(58) Field of Classification Search
CPC ..... D06F 75/28; D06F 75/30; D06F 75/32; D06F 75/40; D06F 75/38; D06F 75/08
USPC ..... D32/68, 70, 71
See application file for complete search history.

(56) References Cited

U.S. PATENT DOCUMENTS

| | | | | |
|---|---|---|---|---|
| 3,032,861 A * | 5/1962 | Foster | D06F 75/24 | 219/530 |
| 4,658,520 A * | 4/1987 | Henneberger | D06F 75/38 | 38/77.83 |
| 4,822,686 A * | 4/1989 | Louison | C23D 5/00 | 38/142 |
| 5,613,309 A * | 3/1997 | Amsel | D06F 75/18 | 38/77.83 |
| 5,619,813 A | 4/1997 | Forest et al. | | |
| 5,804,791 A * | 9/1998 | Gelus | D06F 75/24 | 219/245 |

FOREIGN PATENT DOCUMENTS

| | | |
|---|---|---|
| BE | 500170 A | 1/1951 |
| EP | 0682724 B1 | 5/1997 |
| EP | 2740836 A1 | 6/2014 |
| WO | 2010023141 A1 | 3/2010 |

* cited by examiner

*Primary Examiner* — Ismael Izaguirre
(74) *Attorney, Agent, or Firm* — The Webb Law Firm

(57) ABSTRACT

Iron including a body (2) and a metal soleplate (1) that is folded back against the body (2), the soleplate including a lower surface defining an ironing surface and including, at least locally, a peripheral edge (11) where the soleplate is folded up in the direction of the body (2) and comes into contact with the latter to help attach the soleplate (1) to the body, wherein the peripheral edge (11) includes a portion (12) that is folded 180° at the place where the soleplate (1) extends parallel to the ironing surface, and in that the portion (12) that is folded 180° is extended by a latch part (13) that comes into contact with the body (2).

9 Claims, 4 Drawing Sheets

IRON COMPRISING A BODY AND A METAL SOLEPLATE FOLDED BACK AGAINST THE BODY

CROSS-REFERENCE TO RELATED APPLICATION

This application claims priority to French Patent Application No. 1462081 filed Dec. 8, 2014, the disclosure of which is hereby incorporated in its entirety by reference.

Field of the Invention

This invention pertains to an iron comprising a body and a metal soleplate that is folded back against the body, the soleplate comprising a lower surface defining an ironing surface and having, at least locally, a folded-up edge that defines a peripheral edge of said ironing surface, and pertains more specifically to an iron in which the folded-up edge of the soleplate comes into contact with the body in order to help attach the soleplate to the body.

Description of Related Art

There exists, in patent application EP 0 682 724 filed by the applicant, an iron comprising a soleplate, or cap, which is folded back against a heating body, the soleplate comprising a lower surface defining an ironing surface and comprising a folded-up edge defining a peripheral edge of the ironing surface. In this patent, the soleplate is attached mechanically against the body by bringing the folded-up edge into contact with the body.

Such a solution offers the advantage of providing a simple, inexpensive mechanical means of attaching the soleplate onto the heating body, as this mechanical attachment alone can attach the soleplate onto the body or supplement a layer of glue used to attach the soleplate to the body.

However, such a peripheral edge gripping the heating body presents the disadvantage of being relatively thick, which makes it difficult to iron around clothing buttons. Moreover, the significant thickness of such a peripheral edge also detracts from the visual appearance of the iron.

Consequently, the purpose of this invention is to provide a steam iron comprising an ironing bottom that is attached in a simple, inexpensive manner to the body of the iron, and that has a peripheral edge that is not very thick. Another purpose of the invention is to provide an iron in which the soleplate attachment offers complete freedom in the positioning of steam release holes in the soleplate.

SUMMARY OF THE INVENTION

To this end, the object of the invention is an iron comprising a body and a metal soleplate that is folded back against the body, the soleplate comprising a lower surface defining an ironing surface and comprising, at least locally, a peripheral edge, where the soleplate is folded up in the direction of the body and comes into contact with said body to help attach the soleplate to the body, characterized in that the peripheral edge comprises a portion that is folded 180° at the place where the soleplate extends parallel to the ironing surface, and in that the portion folded 180° is extended by a latch part that comes into contact with the body.

Such a characteristic makes it possible to obtain an iron in which the peripheral edge of the ironing surface is flat and thus not very thick, which makes ironing around clothing buttons easier.

In another characteristic of the invention, the peripheral edge of the ironing surface is of a thickness that is roughly equal to, or less than, twice the thickness of the soleplate.

In another characteristic of the invention, the latch part comprises, successively, starting from the portion folded 180°, an intermediate portion that is folded upward, and then a free end that is pressed down against the body to attach the soleplate to the body.

Such an attachment of the soleplate by the latch parts located at the periphery of the soleplate offers the advantage of being simple and inexpensive to implement. Moreover, this attachment is independent of the positioning of the steam release holes on the soleplate, such that the distribution of steam release holes on the soleplate can be modified without impacting the soleplate attachment.

In another characteristic of the invention, the intermediate portion extends perpendicular to the ironing surface.

In another characteristic of the invention, the free end of the latch part is aligned with the intermediate portion when the soleplate is set in place on the body, and then mechanically pressed down against the body to attach the soleplate.

In another characteristic of the invention, the ironing surface and the peripheral edge of the soleplate are covered with a coating, such as enamel.

Such a coating makes it possible to improve the mechanical characteristics of the ironing surface, and specifically how it slides and/or resists scratching.

In another advantageous characteristic of the invention, the latch part is not covered with the coating.

Such a characteristic prevents the coating from cracking when the latch part is folded.

In another characteristic of the invention, the latch part is covered with the coating at the same time as the peripheral edge and the ironing surface of the soleplate.

Such a characteristic simplifies the coating application process, as the coating can be applied without having to mask the latch parts.

In another characteristic of the invention, the soleplate is made of aluminum.

Such an aluminum soleplate offers the advantage of being easy to manufacture and of transferring heat well.

In another characteristic of the invention, the thickness of the soleplate is between 0.8 mm and 1.5 mm.

In another characteristic of the invention, the body is a heating body that contains an electrical resistor.

The purposes, aspects and advantages of this invention will be better understood through the description provided below of one particular method of implementing the invention, as well as one variation of implementation, presented as non-limiting examples, in reference to the attached drawings, in which:

DETAILED DESCRIPTION OF THE INVENTION

Figure 1:
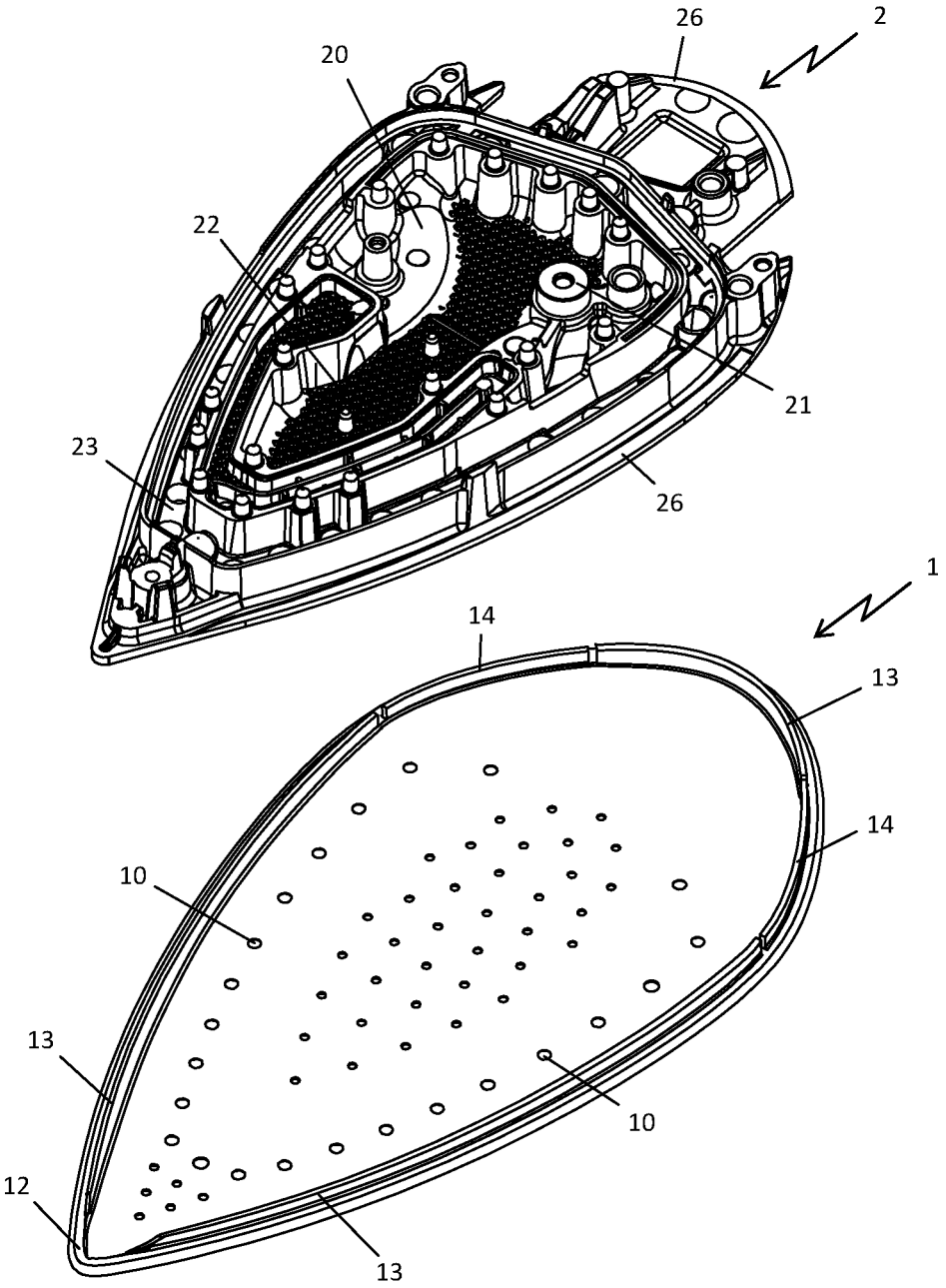
FIGS. 1 and 2 are exploded perspective views of an iron bottom set in one particular method of implementing the invention, the bottom set comprising a soleplate and a heating body.

FIG. 1 shows an iron bottom set situated traditionally below a container of water, not depicted in the drawings, this set comprising a metal soleplate (1) and a heating body (2) designed to be folded back onto the soleplate (1).

The heating body (2) advantageously consists of an aluminum casting comprising an electrical resistor (20) bent into a horseshoe shape, as well as an indentation (21) arranged to house a temperature-regulating thermostat.

The heating body (2) comprises, in its upper portion, a steam chamber (22) designed to be closed by a closure plate, not depicted in the drawings.

The water in the iron's container is brought, in a self-evident manner, by a drip mechanism, into the steam chamber (22), and the steam thus generated is distributed by a peripheral channel (23) extending around the steam chamber, on the upper surface of the heating body (2).

Figure 2:
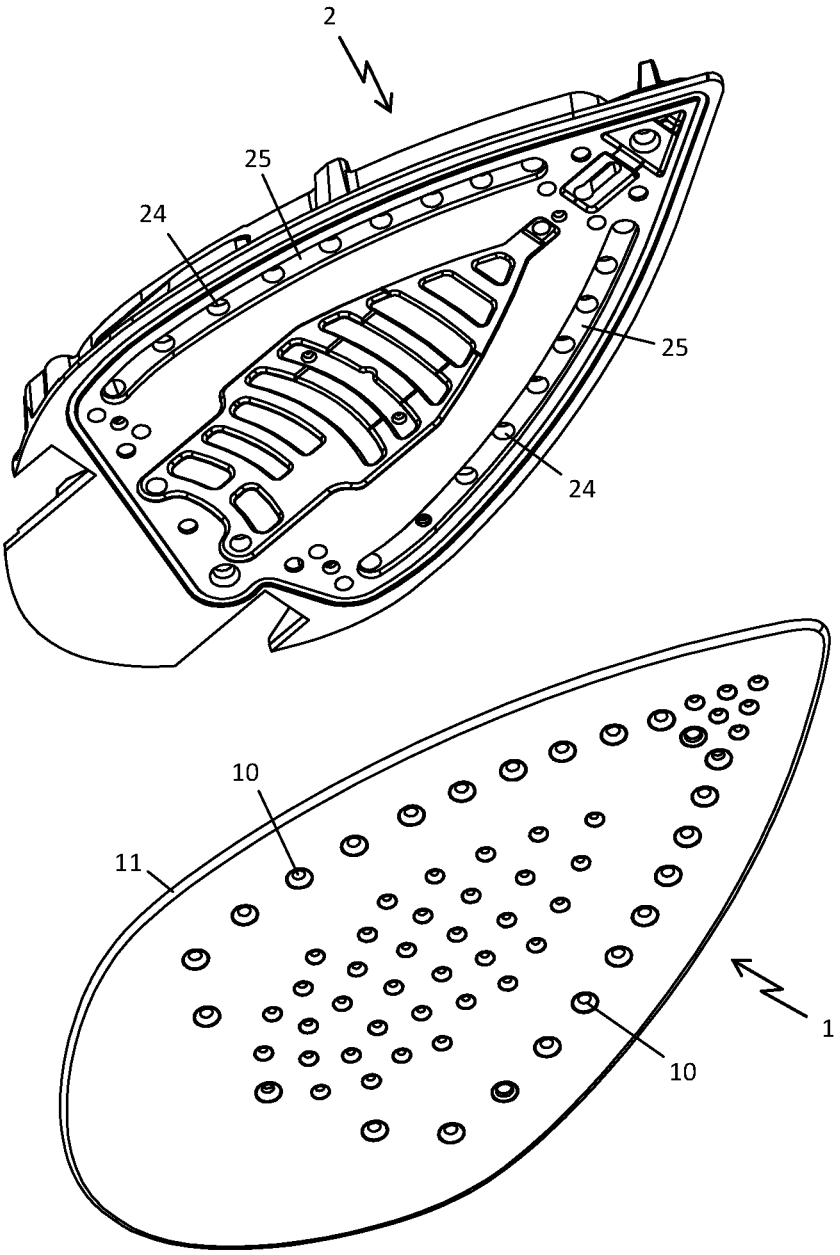
Figure 3:
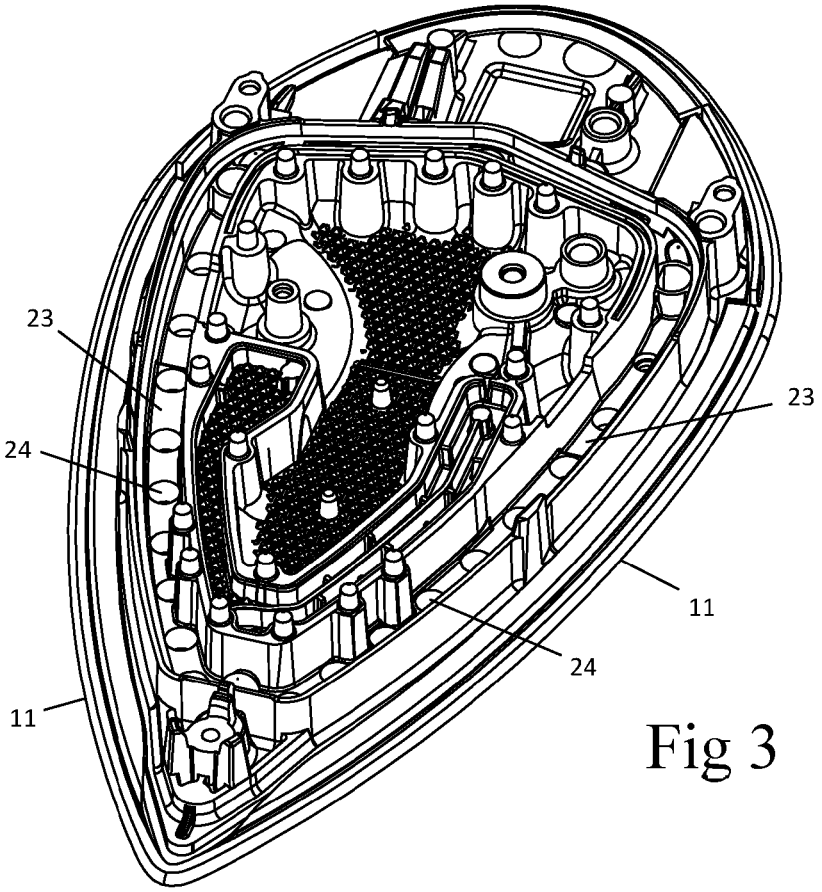
FIG. 3 is a perspective view of the iron bottom set in FIG. 1, with the heating body and the soleplate assembled.
Figure 4:
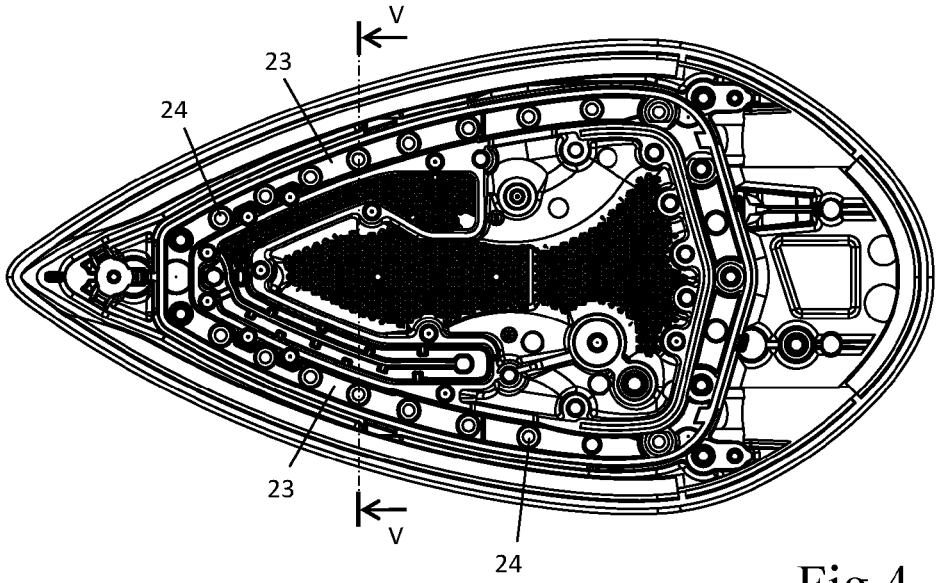
FIG. 4 is a view from above of the iron bottom set in FIG. 3.

As shown in FIGS. 2 through 4, the channel (23) has holes (24) through the heating body (2) and leading into a steam distribution chamber (25) extending on the lower surface of the heating body (2), the distribution chamber (25) supplying a network of steam release holes (10) in the soleplate (1).

The soleplate (1) comprises a flat lower surface that defines an ironing surface, comprising an area equipped with steam release holes (10), that extends through the network of steam release holes, and at which place the upper surface of the soleplate (1) comes into contact with the surfaces of the heating body (2) so as to ensure proper heat transfer from the heating body (2) to the soleplate (1), an airtight seal being arranged at the periphery of the heating body (2) to ensure a seal that is airtight against the steam between the soleplate (1) and the heating body (2).

Figure 5:
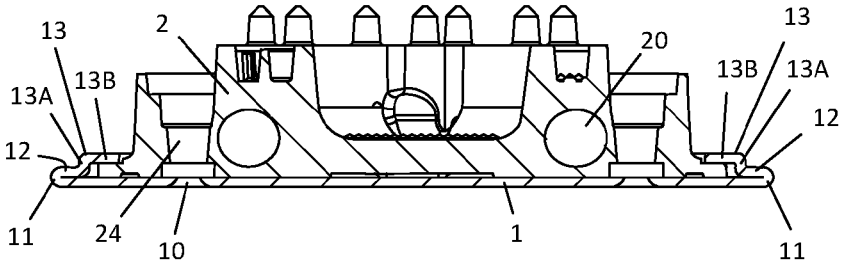
FIG. 5 is a cross-section view along Line V-V in FIG. 4.
Figure 6:
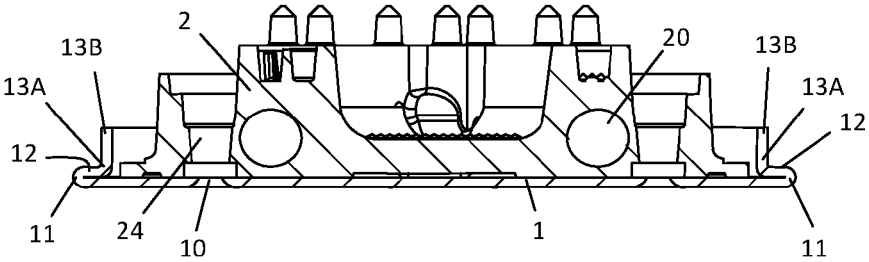
FIG. 6 is a cross-section view, similar to FIG. 5, before folding the latch part against the heating body.

As shown in FIGS. 5 and 6, the soleplate (1) comprises a peripheral edge (11) that defines the perimeter of the ironing surface, the peripheral edge comprising a portion (12) that is folded 180°, obtained by successively folding the soleplate (1) upward, and then toward the interior of the ironing surface, and by pressing it down against the upper surface of the soleplate (1).

The soleplate (1) comprises, locally, in the extension of the portion (12) that is folded 180°, latch parts (13) comprising an intermediate portion (13A) directed upward to form a 90° bend with the folded-up portion, said intermediate portion (13A) being extended by a free end (13B) that extends vertically upward, such that the heating body (2) can be inserted between the latch parts (13) and applied against the soleplate (1) during the iron assembly process.

Such a free end (13B) is then pressed down horizontally on the edge of the heating body (2), such that the latch parts (13) exert pressure on the heating body (2), which holds the soleplate (1) in contact with the heating body (2).

As shown in FIG. 1, these latch parts (13) are advantageously distributed along the periphery of the heating body (2), the soleplate (1) comprising, in the example illustrated in the drawings, two lateral latch parts (13) consisting of flaps extending from each side of the soleplate (1) from one pointed forward end of the soleplate (1), over roughly two-thirds the length of the soleplate (1), and a back latch part (13) consisting of a flap extending to the back end of the soleplate (1), the heating body (2) advantageously comprising, at the height of these latch parts (13), a flat peripheral edge with a casing (26), shown in FIG. 1, that is adapted to receive the latch part (13).

The soleplate (1) may also advantageously comprise guide parts (14) consisting of divider flaps that remain oriented vertically and that cooperate with the edge of the heating body (2) to laterally guide the soleplate (1) with respect to the heating body (2).

Figure 7:
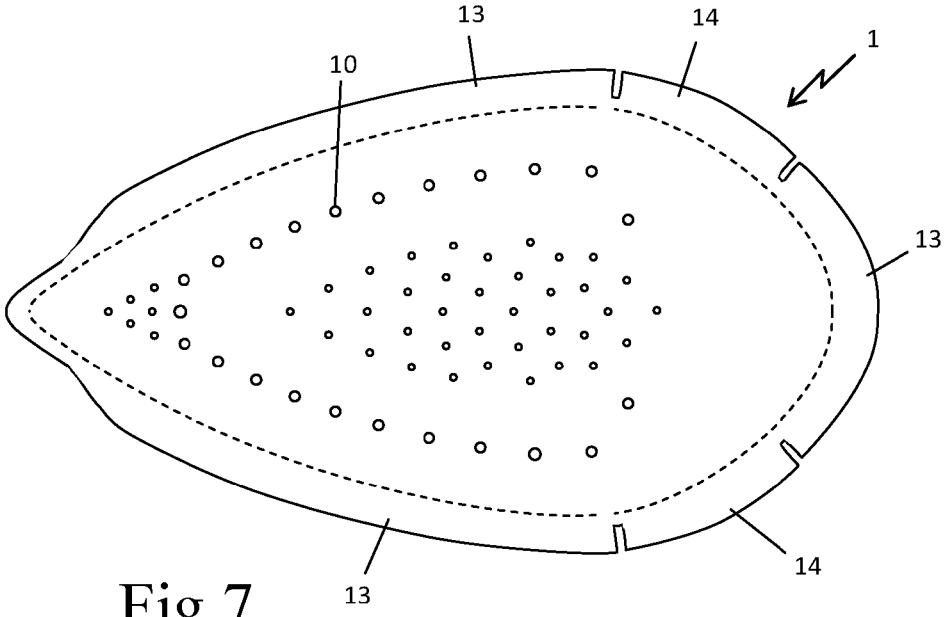
FIG. 7 is a view from above of the soleplate before folding.

FIG. 7 depicts, as an example, the shape of the soleplate (1) prior to folding, said soleplate (1) being obtained by cutting an aluminum sheet that is between 0.8 mm and 1.5 mm thick. This soleplate (1) then undergoes a first folding step, in which the latch parts (13) and the guide parts (14) are folded 90°, and then a second folding step in which the soleplate (1) is folded 180° along the perimeter of the ironing surface, illustrated by a dotted line in FIG. 7, in order to obtain a soleplate as illustrated in FIG. 1, in which the peripheral edge (11) of the ironing surface has a thickness that is roughly equal to twice the thickness of the soleplate (1).

Preferably, the soleplate (1) thus made, is partially coated in enamel prior to its assembly with the heating body (2), as the enamel-coated surface can be limited to the ironing surface and to the peripheral edge (11) of the soleplate (1), while the latch parts (13) can remain in the as-cast state, which is to say not coated in enamel, in order to prevent cracks from forming in the enamel when the latch parts (13) are folded.

However, in one variation of implementing the invention, the latch parts (13) may also be coated in enamel at the same time as the ironing surface, in order to simplify the coating application process. Indeed, the latch parts (13) offer the advantage of being hidden by the casing of the iron when the heating body (2) is assembled to the iron, such that any cracks forming in the coating of the latch parts will not be visible to the user.

The bottom set thus made offers the advantage of being simple and inexpensive to produce, the soleplate offering the advantage of being mechanically connected to the heating body by a simple process of folding the latch parts.

Moreover, the iron equipped with such a bottom set offers the advantage of possessing a soleplate with a flat peripheral edge that is not very thick, allowing for easy ironing around clothing buttons.

Figure 8:
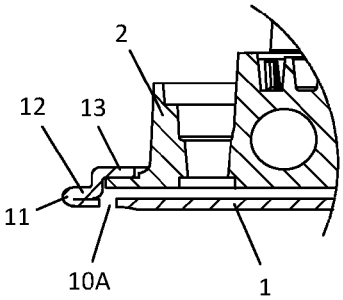
FIG. 8 depicts a detailed view, in a transverse cross-section, of a bottom set according to one variation of implementing the invention.

FIG. 8 depicts one variation of implementing the bottom set illustrated in the previous drawings, in which the soleplate (1) comprises one or more steam release holes (10A) arranged immediately alongside the peripheral edge (11) of the soleplate (1), and advantageously near the front point of the soleplate (1).

In this variation of implementation, the soleplate (1) advantageously comprises a smaller thickness at the periphery of the ironing surface, in order to promote the diffusion of steam toward the external edge of the ironing surface.

Such an ironing variation offers the advantage of comprising steam release holes at the periphery of the ironing surface for greater efficacy when ironing difficult-to-reach corners of clothes, such as the curves of buttons or shirt collars.

Of course, the invention is in no way limited to the methods of implementation described and illustrated, which are provided only as examples. Modifications remain possible, particularly with respect to the constitution of the various components or by substituting equivalent techniques, while still remaining within the scope of protection of the invention.

Thus, in one variation of implementing the invention that is not depicted, the latch parts may cover the entire perimeter of the heating body or be located only in several places distributed along the periphery of the heating body.

Thus, in one variation of implementing the invention that is not depicted, the soleplate may be made of stainless steel.

Thus, in one variation of implementing the invention that is not depicted, the soleplate may be coated with an inorganic polymer-type coating applied using a sol-gel process.

Thus, in one variation of implementing the invention that is not depicted, the body onto which the soleplate is attached may not be a heating body.

The invention claimed is:

1. Iron comprising a body (2) and a metal soleplate (1) that is folded back against the body (2), the soleplate (1) comprising a lower surface defining an ironing surface and comprising, at least locally, a peripheral edge (11) where the soleplate (1) is folded up in the direction of the body (2) and comes into contact with the latter to help attach the soleplate (1) to the body, wherein the peripheral edge (11) comprises a portion (12) that is folded 180° at a place where the soleplate (1) extends parallel to the ironing surface and where the peripheral edge (11) has a thickness of less than or equal to twice the thickness of the soleplate (1), and wherein the portion (12) that is folded 180° is extended by a latch part (13) that comes into contact with the body (2).

2. Iron described in claim 1, wherein the latch part (13) comprises, successively, starting from the portion (12) that is folded 180°, an intermediate portion (13A) folded upward, and then a free end that is pressed down against the body (2) in order to attach the soleplate (1) to the body (2).

3. Iron described in claim 2, wherein the intermediate portion (13A) extends perpendicular to the ironing surface.

4. Iron described in claim 2, wherein the free end (13B) of the latch part (13) is aligned with the intermediate portion (13A) when the soleplate (1) is set in place on the body (2), and then is pressed down mechanically against the body (2) to attach the soleplate (1).

5. Iron described in claim 1, wherein the ironing surface and the peripheral edge (11) of the soleplate (1) are covered with a coating.

6. Iron described in claim 5, wherein the latch part (13) is not covered with said coating.

7. Iron described in claim 1, wherein the soleplate (1) is made of aluminum.

8. Iron described in claim 1, wherein the thickness of the soleplate (1) is between 0.8 mm and 1.5 mm.

9. Iron described in claim 1, wherein said body (2) is a heating body and contains an electrical resistor (20).

* * * * *